US008739498B2

(12) United States Patent
Wilkinson et al.

(10) Patent No.: US 8,739,498 B2
(45) Date of Patent: Jun. 3, 2014

(54) FIRE DOOR

(75) Inventors: John Wilkinson, Big Sandy, TN (US); Bobby Neal Strickland, Trenton, TN (US); Thomas Janicak, Hampshire, IL (US); Jeffrey Badgett, Milan, TN (US); Mark Drake, Chula Vista, CA (US)

(73) Assignee: Assa Abloy Door Group, LLC, New Haven, CT (US)

( * ) Notice: Subject to any disclaimer, the term of this patent is extended or adjusted under 35 U.S.C. 154(b) by 0 days.

(21) Appl. No.: 13/588,523

(22) Filed: Aug. 17, 2012

(65) Prior Publication Data

US 2014/0047785 A1 Feb. 20, 2014

Related U.S. Application Data

(60) Provisional application No. 61/683,001, filed on Aug. 14, 2012.

(51) Int. Cl.
*E04C 2/32* (2006.01)

(52) U.S. Cl.
USPC .... 52/783.13; 52/232; 52/783.18; 52/784.11; 52/784.15; 52/800.1

(58) Field of Classification Search
USPC ..... 52/232, 783.11, 783.12, 783.13, 784.1, 52/784.11, 784.12, 784.13, 784.15, 52/783.17, 783.18, 783.19, 784.14, 52/787.11, 800.1
See application file for complete search history.

(56) References Cited

U.S. PATENT DOCUMENTS

| | | | | | |
|---|---|---|---|---|---|
| 1,202,316 | A * | 10/1916 | Ries | 52/784.1 |
| 4,263,752 | A * | 4/1981 | Jungbluth | 49/501 |
| 4,282,687 | A * | 8/1981 | Teleskivi | 49/503 |
| 4,489,121 | A * | 12/1984 | Luckanuck | 428/192 |
| 4,811,538 | A * | 3/1989 | Lehnert et al. | 52/455 |
| 5,522,195 | A * | 6/1996 | Bargen | 52/455 |
| 5,603,194 | A * | 2/1997 | Fridlyand et al. | 52/515 |
| 6,112,496 | A * | 9/2000 | Hugus et al. | 52/784.11 |
| 6,619,010 | B2 * | 9/2003 | Wang Chen | 52/784.13 |
| 6,643,991 | B1 * | 11/2003 | Moyes | 52/784.11 |
| 7,721,500 | B2 * | 5/2010 | Clark et al. | 52/455 |
| 7,897,235 | B1 * | 3/2011 | Locher et al. | 428/76 |
| 2002/0189182 | A1 * | 12/2002 | Record | 52/309.9 |
| 2003/0033786 | A1 * | 2/2003 | Yulkowski | 52/784.15 |
| 2003/0150182 | A1 * | 8/2003 | Chou et al. | 52/309.8 |
| 2009/0038261 | A1 * | 2/2009 | Lee et al. | 52/784.11 |

* cited by examiner

*Primary Examiner* — Adriana Figueroa
(74) *Attorney, Agent, or Firm* — DeLio, Peterson & Curcio, LLC; Peter W. Peterson; Thomas E. Ciesco

(57) ABSTRACT

An insulated fire door includes a door shell having spaced first and second exterior panels and a gypsum panel between the first and second exterior panels. The insulated fire door includes a plurality of spacers bonded across an interior side of each of the first and second exterior panels. The spacers maintain the gypsum panel in a spaced position from the interior sides of the first and second exterior panels as the door bows during a fire on one side of the door, until the gypsum disintegrates. Each of the spacers may have a flat portion contacting the gypsum panel, a leg extending from the flat portion spacing the gypsum from the interior sides of the first and second exterior panels, and a flange extending from the leg bonding the spacer to the first and second exterior panels.

16 Claims, 8 Drawing Sheets

FIRE DOOR

BACKGROUND OF THE INVENTION

1. Field of the Invention

The present invention relates to doors having a fire rating and in particular, narrow and/or tall doors having an improved fire rating.

2. Description of Related Art

Fire doors are made to resist a rise in temperature over a desired degree on the side of the door opposite the fire or other combustion source. Fire doors also must maintain a certain degree of rigidity, and resist gaps or other openings from developing which will cause passage of flames directly around or through the door. While fire doors of conventional widths of about 32 in. (0.81 m) or more and heights no greater than about 84 in. (2.13 m) are able to meet various fire standards, it has been difficult to meet such fire standards in narrower and taller doors.

SUMMARY OF THE INVENTION

Bearing in mind the problems and deficiencies of the prior art, it is therefore an object of the present invention to provide a fire door having improved fire resistance, particularly at narrower widths.

A further object of the invention is to provide a fire door which passes specific Underwriters' Laboratories and ANSI tests requirements.

Still other objects and advantages of the invention will in part be obvious and will in part be apparent from the specification.

The above and other objects, which will be apparent to those skilled in the art, are achieved in the present invention which is directed to an insulated fire door comprising a door shell having spaced first and second exterior panels and a gypsum panel between the first and second exterior panels. The insulated fire door includes a plurality of spacers bonded across an interior side of each of the first and second exterior panels. The spacers extend inward from the first and second exterior panels and contact the gypsum panel. The spacers maintain the gypsum panel in a spaced position from the interior sides of the first and second exterior panels as the door bows during a fire on one side of the door, until the gypsum disintegrates. The gypsum panel may extend along substantially all of the interior sides of the first and second exterior panels. Each of the spacers may have a flat portion contacting the gypsum panel, a leg extending from the flat portion spacing the gypsum from the interior sides of the first and second exterior panels, and a flange extending from the leg bonding the spacer to the first and second exterior panels. The spacers may have a length extending vertically within the door, and may be welded to the first and second exterior panels.

The fire door may include a C-shaped stiffener extending vertically within the door between the interior sides of the first and second exterior panels. The C-shaped stiffener may have a leg spacing the interior sides of the first and second exterior panels and flanges extending from the leg bonding the stiffener to at least one of the first and second exterior panels. The door may have hinges along a first edge thereof, and the C-shaped stiffener may extend vertically between the first and second exterior panels near a second edge opposite the first edge.

The door may be an active door and include hinges along a first edge thereof and a lock pocket along a second edge opposite the first edge, and may further include a mineral wool insulation around the lock pocket and between the first and second exterior panels. The mineral wool insulation may extend along a top, bottom and side of the lock pocket between the first and second exterior panels. The door may have hinges along a first edge thereof and a lock pocket along a second edge opposite the first edge, and may further include a stiffener extending vertically between the first and second exterior panels, with the stiffener being disposed between the first and second edges adjacent the lock pocket.

The door may be an inactive door and have hinges along a first edge thereof and a strike pocket along a second edge opposite the first edge, and may further include a mineral wool insulation along the second edge and between the first and second exterior panels. The door may have hinges along a first edge thereof and a strike pocket along a second edge opposite the first edge, and may further include a stiffener extending vertically between the first and second exterior panels, the stiffener disposed between the first and second edges near the second edge.

The door may have hinges along a first edge thereof, and may further include a stiffener extending vertically between the interior sides of the first and second exterior panels near a second edge opposite the first edge, the stiffener extending along an edge of the gypsum panel. The door may further include a sheet of ceramic paper extending over the stiffener and overlapping the edge of the gypsum panel. The gypsum panel may have a thickness sufficient to permit heat from a fire on one side of the door to flow through the gypsum panel and cause the first and second exterior panels to bow substantially uniformly as a result of thermal expansion thereof, while maintaining sufficient spacer contact with the gypsum panel and having sufficient thermal insulation to meet a fire code, until the gypsum disintegrates. The door may have a width less than about 32 in. (0.81 m) and/or has a height greater than about 84 in. (2.13 m).

In another aspect the present invention is directed to an insulated fire door system having as an active door as described above and as an inactive door as described above. The active door has hinges along a first edge thereof and a lock pocket along a second edge opposite the first edge. The inactive door has hinges along a first edge thereof and a strike pocket along a second edge opposite the first edge. The active and inactive doors meet at their second edges. The active door of the door system may have a flexible thermal insulation around the lock pocket between the first and second exterior panels and the inactive door of the door system may have a strike pocket along the second edge and a flexible thermal insulation along the second edge between the first and second exterior panels.

In a further aspect the present invention is directed to a method of using a fire door comprising providing the insulated fire door as described above, exposing the door to a heat source on one side of the door and causing the door to bow toward the heat source as a result of thermal expansion of the first and second exterior panels. The method may include using the spacers to maintain the gypsum panel in a spaced position from the interior sides of the first and second exterior panels as the door bows, until the gypsum disintegrates.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-11 of the drawings in which like numerals refer to like features of the invention.

Figure 1:
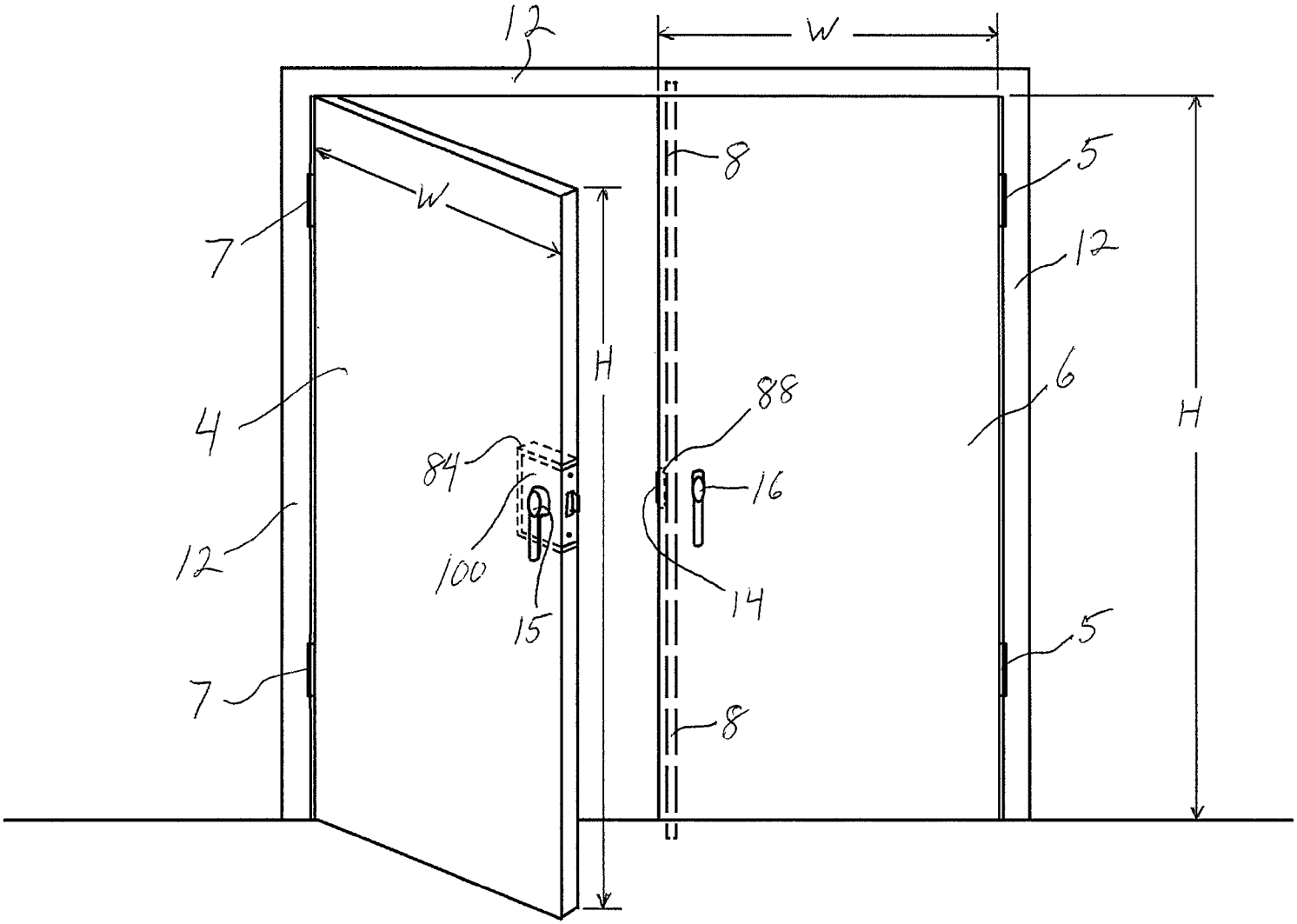
FIG. 1 is a perspective view of a set of double doors including an active door and an inactive door.

In referring to double door systems such as shown in the perspective view of FIG. 1, an inactive door 6 is a door having width W and height or length H which is usually in a fixed position within a door frame 12, but may include hinges 5 on one edge of the door 6, on the opposite free edge of the door a strike 14 and strike pocket 88, a rod 8 extending from above the door 6 to a location below the door for locking to the door frame 12, and a handle 16. The inactive door 6 is generally left in a closed position, and may be opened when additional entry width is needed. An active door 4 is a door which is normally opened and used. The active door 4 has width W and height or length H and may include a lock 100 disposed within a lock pocket 84 on the free edge of the door, adjacent the free edge of the inactive door, for securing the active door to a strike 14 in the inactive door in a closed position, and a handle 15 for retracting the lock and releasing the active door 4 from the inactive door 6. The active door 4 may include at least one hinge 7 to allow the active door 4 to pivot. The active door may be juxtaposed adjacent an inactive door as shown, or may be constructed by itself within a frame 12, without the inactive door, with the lock 100 engaging a strike in the frame. Both active and inactive doors may be movable from a closed position to an open position and from an open position to a closed position.

Figure 2:
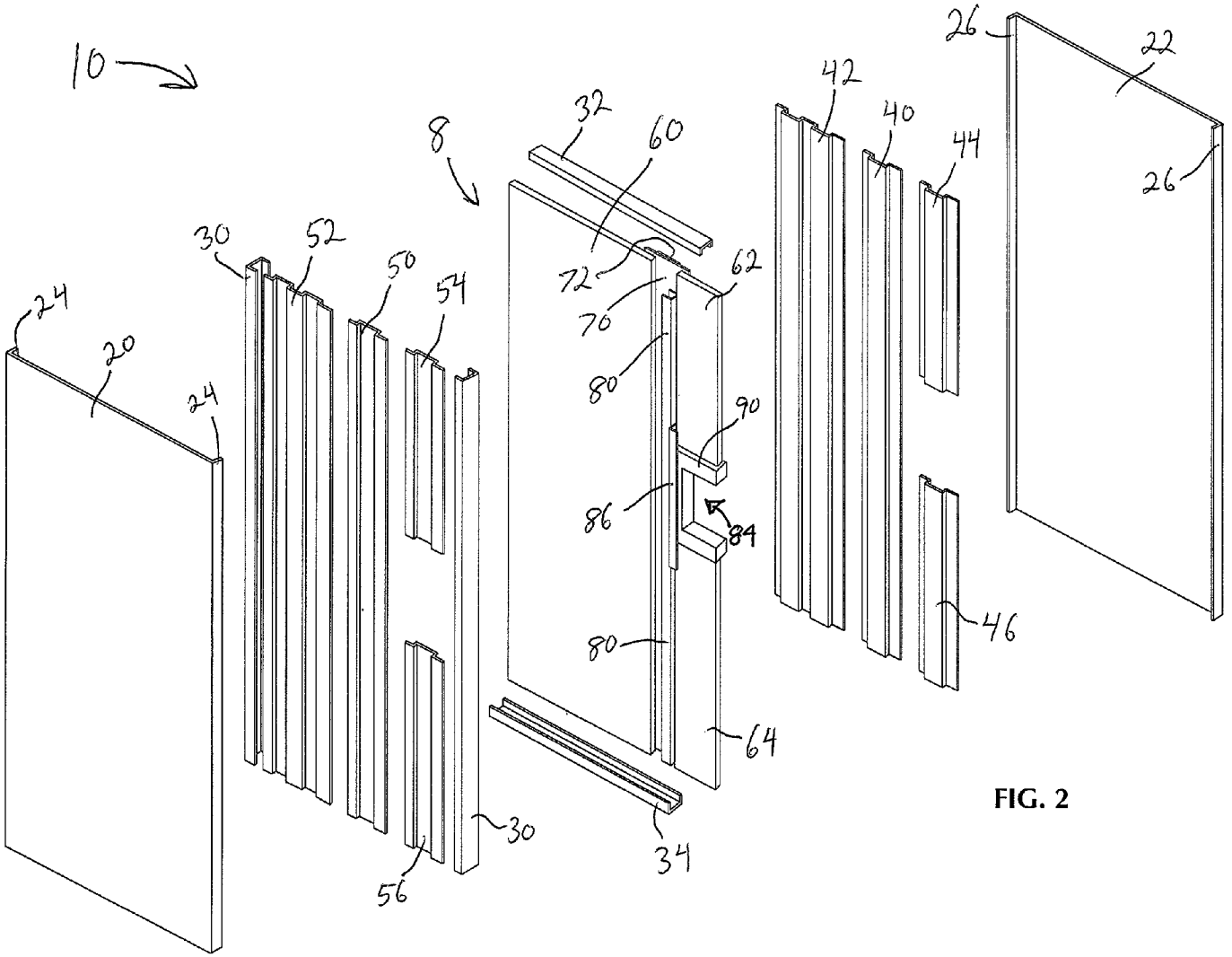
FIG. 2 is an exploded view of an active fire door according to the present invention.
Figure 3:
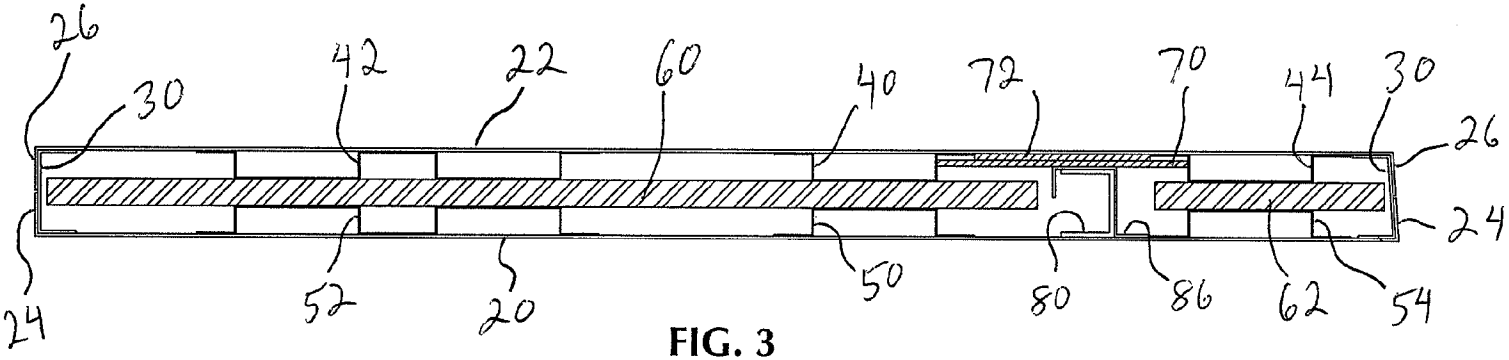
FIG. 3 is a top elevational view of the active fire door of FIG. 2.

FIG. 2 shows an exploded view of an active fire door 10, also shown in a top elevational view of FIG. 3. The active fire door 10 includes a door shell having a first exterior panel or front door skin 20 and a second exterior panel or rear door skin 22. The front door skin 20 includes end flaps 24 extending lengthwise along each edge of the front door skin 20 and the rear door skin 22 includes end flaps 26 extending lengthwise along each edge of the rear door skin 22. The end flaps 24 extend horizontally toward the rear door skin 20 and the end flaps 26 extend vertically toward the front door skin 20.

Figure 4:
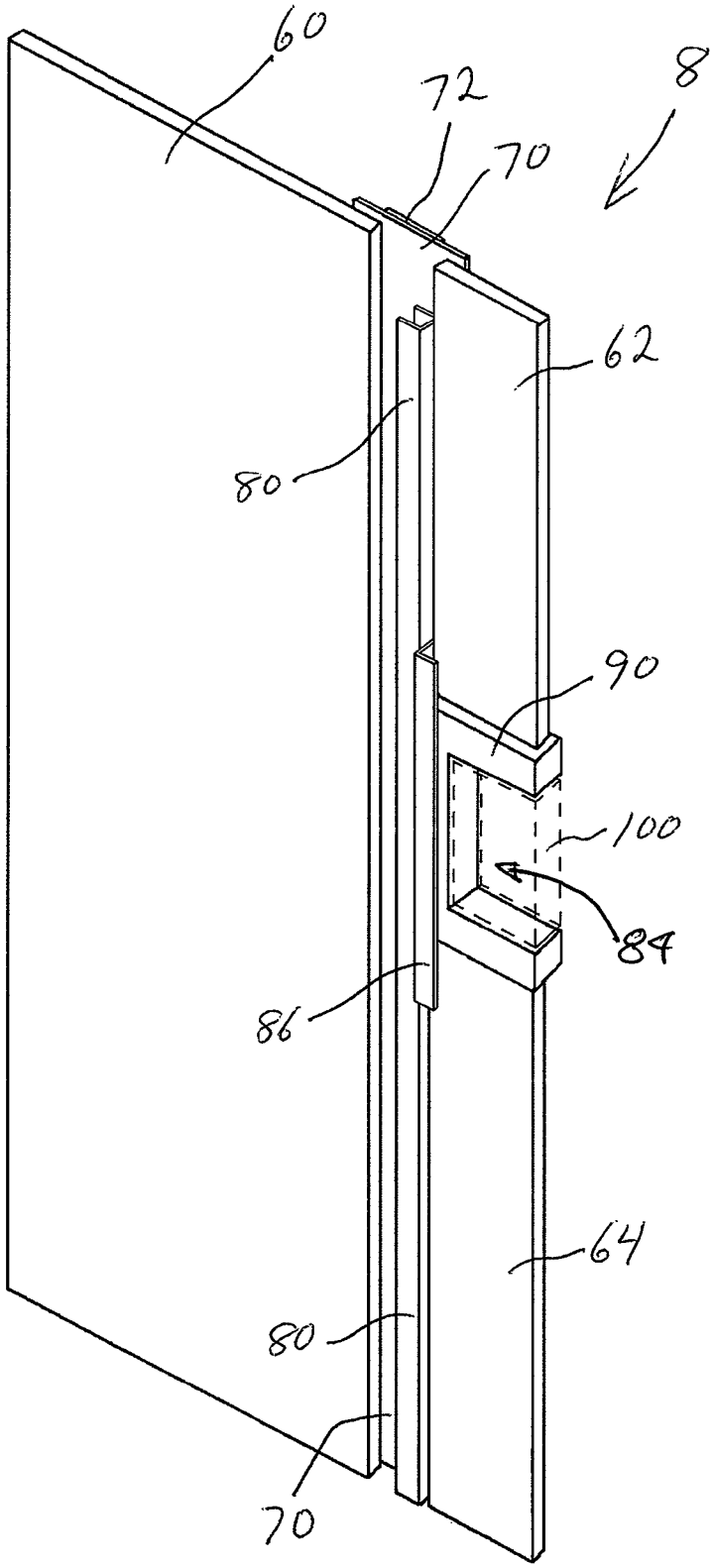
FIG. 4 is a perspective view of the center portion of the active door of FIG. 2.

The active fire door 10 comprises an interior portion 8, shown in an enlarged view of FIG. 4, which includes gypsum panel 60, a first, wide section of ceramic paper 70 and a second, narrow section of ceramic paper 72 adjacent the wide section of ceramic paper 70. The interior portion 8 includes a vertical lock edge stiffener 80 and a lock edge retainer 86 adjacent a portion of the vertical lock edge stiffener 80, shown as a length of a C-shaped channel (as seen in cross section perpendicular to the length direction). Edge stiffener 80 is positioned near the free edge of active door 10. A C-shaped section (as seen in a front view of the door) of mineral wool 90 is positioned adjacent the lock edge retainer 86. The C-shaped section of mineral wool 90 extends above, below and to the inside around a lock pocket 84 for receiving a lock 100 (shown in phantom lines in FIG. 4), which may be a mortise lock. The ceramic paper 70 may be positioned adjacent a portion of the lock edge stiffener 80 and a portion of the gypsum panel 60, and may overlap both.

The active fire door 10 includes elongated spacers or hat sections 50, 52, 54 and 56 for spacing and securing the interior surface of front door skin 20 to one face of the gypsum panel 60. Elongated spacers or hat sections 40, 42, 44 and 46 secure the interior surface of rear door skin 22 to the opposite face of the gypsum panel. Spacer 50 is shown in the longitudinal cross sectional view of FIG. 5 and is substantially the same in cross section as spacers 40, 44, 46, 54, and 56. Spacer 50 includes a flat portion 48 fastened to the gypsum panel 60, legs 58 extending from the flat portion 48 and flange sections 68 extending from the legs 58. Spacer 52 is shown in the cross sectional view of FIG. 6 and is substantially the same in cross section as spacer 42. Spacer 52 includes a flat portion 48' fastened to the gypsum panel 60, legs 58' extending from the flat portions 48' and flange sections 68' extending from the legs 58'. Spacers 40, 42, 50 and 52 extend vertically within substantially the entire length or height of the door.

Upper spacers 44 and 54 are positioned a distance above lower spacers 46 and 56 to allow a pocket 84 for the lock to be located along the free edge of the door. Except for the length spacers, 44, 46, 54 and 56 are substantially the same as spacers 40 and 50. Mineral wool 90 is positioned between the door skins around the pocket area 84 between the upper spacers 44, 54 and lower spacers 46, 56. Gypsum panel 62 is positioned above mineral wool 90 and between spacer 44 and spacer 54 and gypsum panel 64 is positioned below mineral wool 90 and between spacer 46 and spacer 56. The gypsum panels 60, 62, 64 extend along substantially all of the interior sides of the first and second exterior panels.

Figure 6:
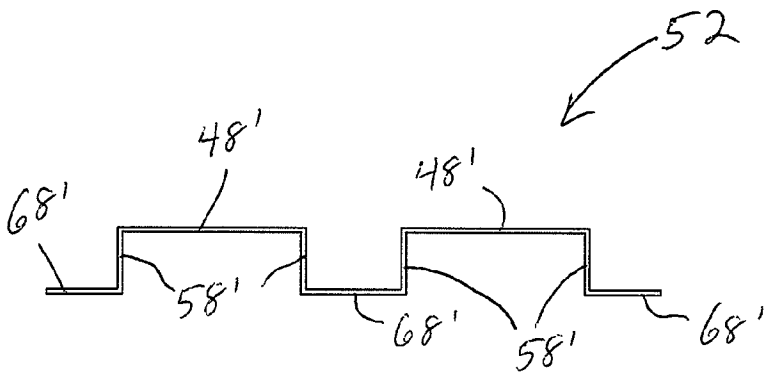
FIG. 6 is a cross sectional view of the double spacer according to the present invention.
Figure 5:
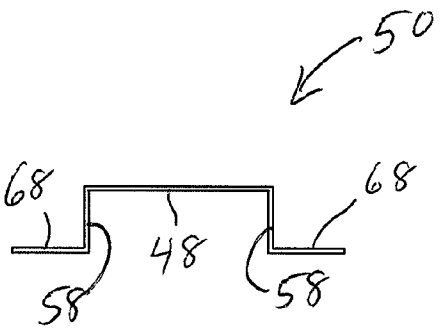
FIG. 5 is a cross sectional view of the spacer according to the present invention.

The length of legs 58, 58' as shown in FIGS. 5 and 6 establish the spacing between the interior surfaces of the door skins and the opposing faces of the gypsum panel. On all the spacers 40, 42, 44, 46, 50, 52, 54, 56, flange sections 68, 68' contact the respective door skins 20, 22, and may be secured to the interior surface of the respective door skin by adhesive or by welding, for example, resistance or spot welding. Edge stiffener 80 has a leg spacing the interior sides of the door skins, and has a flange that may be secured to the interior surface of door skin 20 by adhesive or by resistance, spot or other welding. The spacers may be bonded to the gypsum panels 60, 62, and 64 by bonding at the flat portion 48, 48' with an adhesive such as a two-part epoxy or glue.

The ceramic paper 70 extends substantially the height or length of the fire door 10 and may be positioned on the side of the fire door 10 most likely to face the fire, adjacent the lock edge stiffener 80. The ceramic paper 70 resists heat transfer in a portion of the fire door between the gypsum panel 60 and the upper and lower gypsum panels 62, 64, and may overlap both. The ceramic paper 72 is positioned between the ceramic paper 70 and the fire side door skin 22. The width of the ceramic paper 72 extends between spacer 40 and spacers 44, 46. The ceramic paper 70 is positioned between the lock edge retainer 86 and the ceramic paper 72. The ceramic paper 70 may include a width extending between the legs of spacers 40 and spacers 44, 46. Side edge channels 30, lower end channel 34 and upper end channel 32 are each C-channels which surround the fire door interior portion 8 and the spacers 50, 52, 54, 56, 40, 42, 44 and 46. The channels 30, 32 and 34 may be bonded to the front door skin 20 and rear door skin 20 by the same type of bonding or welding as the spacers.

Figure 7:
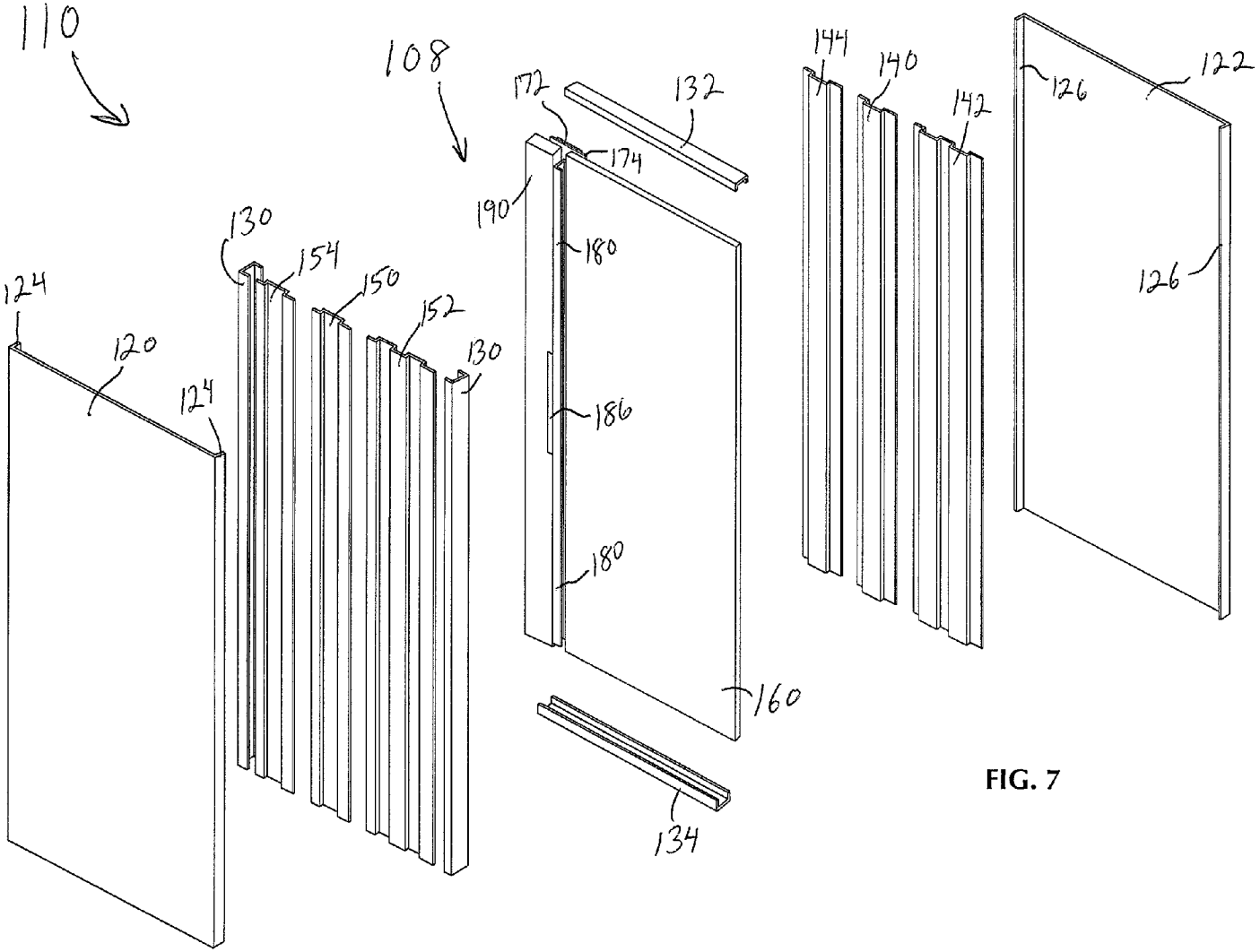
FIG. 7 is an exploded view of an active fire door according to the present invention.
Figure 8:
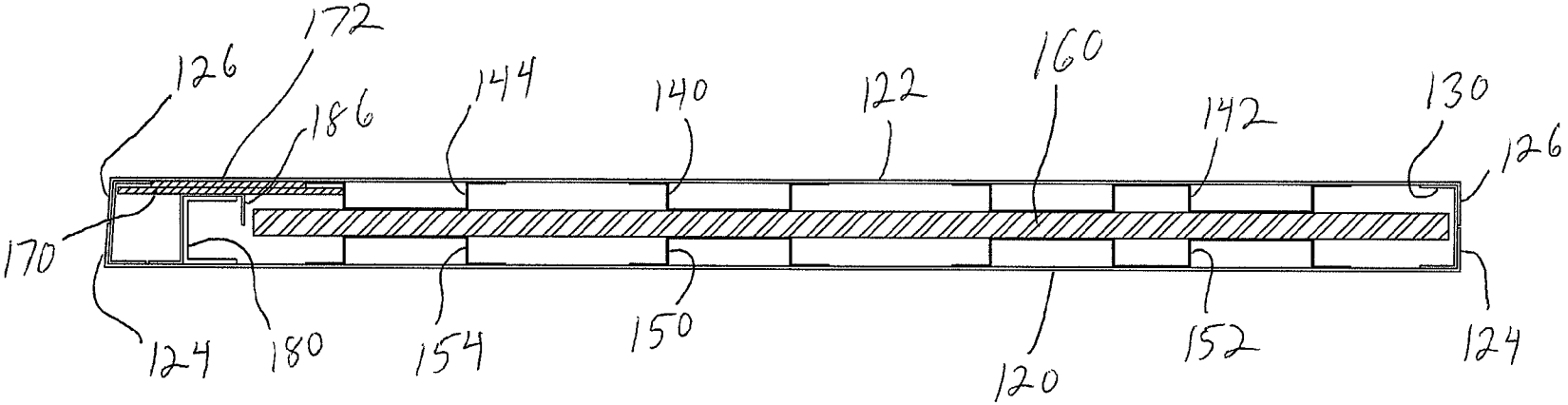
FIG. 8 is a top elevational view of the inactive fire door of FIG. 7.

FIG. 7 shows an exploded view of an inactive fire door 110 also shown in a top elevational view of FIG. 8. The inactive fire door 110 includes a first exterior panel or front door skin 120 and a second exterior panel or rear door skin 122. The front door skin 120 includes end flaps 124 extending lengthwise along each edge of the front door skin 120 and the rear door skin 122 includes end flaps 126 extending lengthwise along each edge of the rear door skin 122. The end flaps 124 extend horizontally toward the rear door skin 120 and the end flaps 126 extend vertically toward the front door skin 120.

Figure 9:
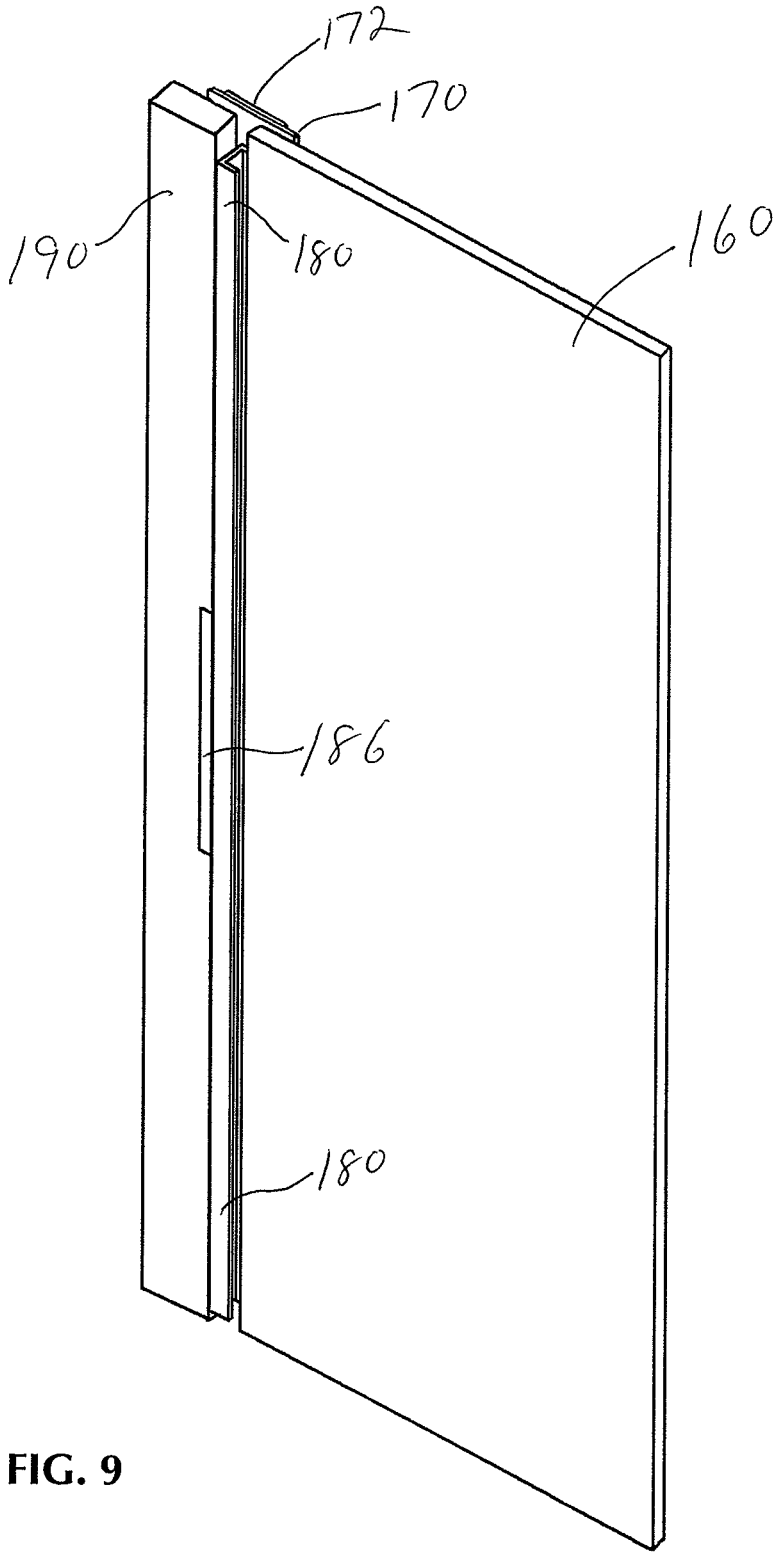
FIG. 9 is a perspective view of the center portion of the inactive door of FIG. 7.

The inactive fire door 110 comprises an interior portion 108, shown in an enlarged view of FIG. 9 which includes a gypsum panel 160, a wide section of ceramic paper 170 and may include a narrow section of ceramic paper 172 adjacent the wide section of ceramic paper 170. As with the active door, gypsum panel 160 extends along substantially all of the interior sides of the first and second exterior panels. The interior portion 108 includes a vertical lock edge stiffener 180 and a lock edge retainer 186 adjacent a portion of the vertical lock edge stiffener 180. Edge stiffener 180 is positioned near the free edge of inactive door 110. An elongated section of mineral wool 190 is positioned between the door skins adjacent the edge of the inactive door 110 and may surround a lock portion which is preferably a sliding rod 8 (FIG. 1) extending into the floor or upper door frame along which the fire door is located. The ceramic paper 170 may be positioned adjacent a portion of the lock edge stiffener 80 and a portion of the gypsum panel 160, and may overlap both.

The inactive fire door 110 includes spacers or hat sections 150, 152 and 154 for securing the front door skin 120 to one face of the gypsum panel 160. Spacers 140, 142 and 144 secure the rear door skin 122 to the opposite face of the gypsum panel. All spacers 140, 142, 144, 150, 152, 154 extend vertically within substantially the entire height or length of the inactive door. Side edge channels 130, lower end channel 134 and upper end channel 132 are each C-channels, which surround the fire door interior portion 108 and the spacers 150, 152, 154, 156, 140, 142, 144 and 146. The individual spacers, edge stiffeners and channels of the inactive door are substantially the same configuration as those of the active door, and are bonded or welded to the door skins in the same manner.

Figure 10:
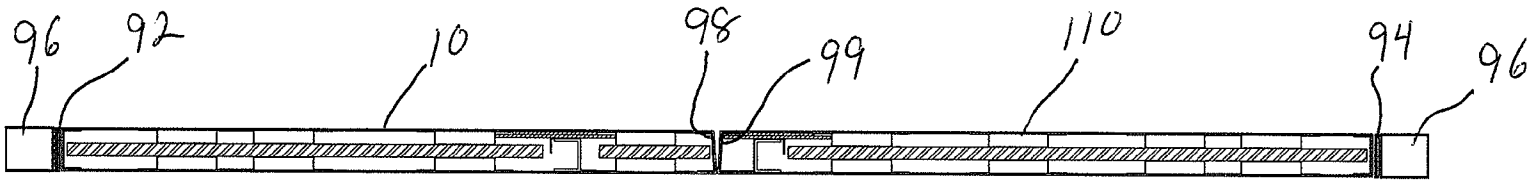
FIG. 10 is a top elevational view of an active and inactive door in a closed position within a door frame.
Figure 11:
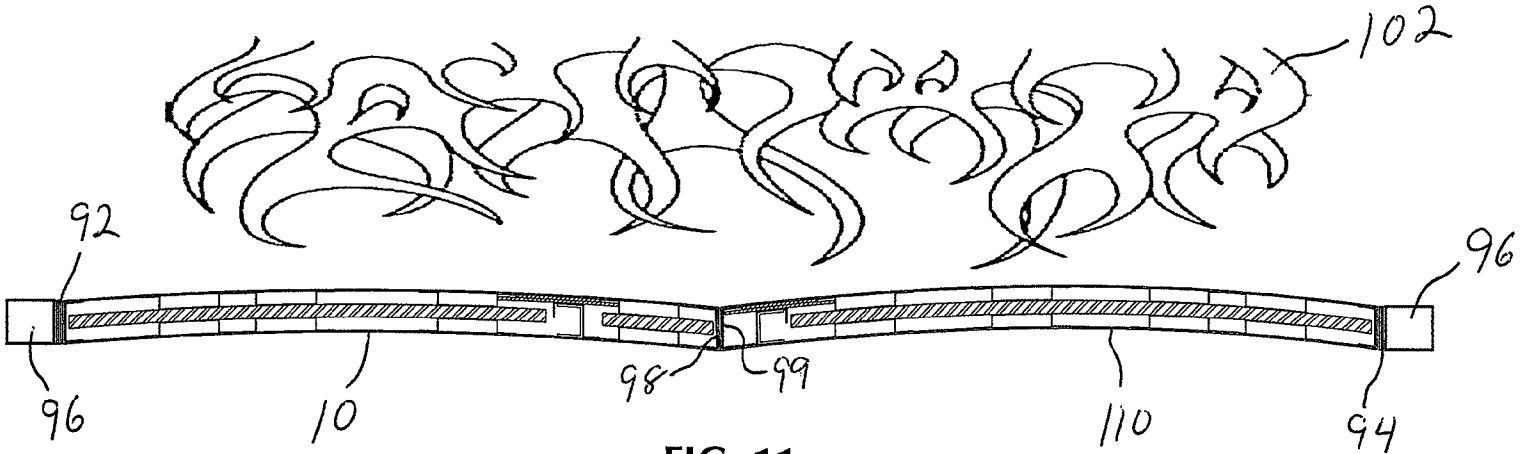
FIG. 11 is a top elevational view of an active and inactive door within a door frame and with a fire on one side of the doors.

FIG. 10 shows the active door 10 having hinges 92 attached to one side a double door frame 96. The inactive door 110 includes hinges 94 attached to the opposite side of the door frame 96. The active and inactive doors meet and are secured to each other by their respective lock and strike at free edges 98 and 99, respectively. The active door 10 includes a beveled edge 98 along the active door free edge adjacent the inactive door 110. The inactive door 110 includes a beveled edge 99 along the inactive door free edge adjacent the active door 10. As shown in FIG. 11, the active door 10 and inactive door 110 are in a closed position with a fire 102 on one side of the door. As a result of the heat of the fire, and the thermal expansion of the door skins, the active door 10 and inactive door 110 are bowed toward the fire 102. The beveled edges 98, 99 provide a tighter seal between the beveled edges 98, 99 when the doors 10, 110 bow into the fire 102, allowing less leakage between the sides of the doors exposed to a fire and the unexposed sides of the doors.

The door skins, spacers, edge stiffeners and channels may be made from low carbon or other sheet steel. The doors (active or inactive) may be of any outside thickness, such as 1.75 in. (44.5 mm). The door skins may be made of 16 gauge steel, with a thickness range of about 0.053-0.059 in. (1.35-1.50 mm), to provide an inside spacing of about 1.625 in. (41.3 mm) between the inner surfaces of the door skins. Each door may be of any desired width and height, although the present invention is particularly useful for narrower doors, i.e., those having a width W less than about 32 in. (0.81 m), preferably no greater than about 24 in. (0.61 m), and taller doors, i.e., those having a height or length H greater than about 84 in. (2.13 m), preferably up to about 96 in. (2.44 m) or more.

The primary thermal insulation for the doors of the present invention is provided by the gypsum panel(s), which spans substantially the entire width of the door, and substantially the entire height or length of the door. Gypsum board is also known as plasterboard, wallboard or drywall and is made in panel form by gypsum plaster pressed between two thick sheets of paper. Gypsum is a very soft sulfate mineral composed of calcium sulfate dihydrate, with the chemical formula $CaSO_4.2H2O$, and gypsum plaster is produced by heating gypsum to about 300° F. (150° C.). The preferred gypsum board is Sheetrock Firecode Core Type X brand in a thickness of about ⅝ in. (16 mm) available from United States Gypsum Company of Chicago, Ill.

An advantage of the invention is the ability of the fire door to control the bowing into a fire when the door reaches temperatures associated with a fire. The doors of the present invention are constructed to meet the standards for physical endurance for door swing and twist of ANSI A250.4-2011 published by the American National Standards Institute, Inc. and the Steel Door Institute. More significantly, the doors of the present invention are constructed to meet the standard for positive pressure fire tests of door assemblies of UL 10C published by Underwriters Laboratories Inc. of Northbrook, Ill. The doors are exposed to gas-fired burner combustion sources on one side at specified temperatures and times. Temperature measurements are taken of at least three portions of the unexposed door skin surface, i.e., the side of the door away from the heat source, and cotton pads are applied at specified regular intervals nears cracks, holes, or other openings in or around the door. During the fire test, the steel door skins are subject to thermal expansion and bow outward toward the source of the heat and are deformed up to about 8 in. (20 cm) or more in a direction normal to the original plane of the door at room temperature. As the door is deformed and distorts under the rising temperature, the gypsum panel is held in place and spaced from the inner sides of the door skins by the spacer sections, which distribute the stress to preserve the integrity of the gypsum panel. Since gypsum panels are somewhat brittle, and because exposure to high heat degrades and eventually chars the paper covering of the gypsum panel, the gypsum panels ultimately degrade and disintegrate. Surprisingly, when used on narrower doors, e.g., doors of about 24 in. (0.61 m) width, the gypsum panel permits sufficient heat to flow from the door skin exposed to the combustion source through the panel to the opposite door skin on the unexposed side to cause the opposite door skins to expand with temperature and bow substantially uniformly. This enables the spacer sections to maintain sufficient spacer contact and hold the position and integrity of the gypsum panel for a sufficient amount of time, up to three (3) hours or more, to provide the desired insulation qualities, before it disintegrates.

Narrower doors made without the gypsum panels of the present invention, but with conventional insulation of higher thermal insulative value, do not pass the UL 10C standard. While not wishing to be bound by theory, it is believed that the lower thermal insulative value of the gypsum panel permits additional heat to pass through to the unexposed door skin, thereby permitting a more controlled expansion of both door skins during exposure. Although the exposed side of the door may reach temperatures of about 1800-1900° F. (1000-1050° C.) over ambient after 30 minutes, the unexposed side of the door of the present invention does not exceed a temperature of about 450° F. (250° C.) over ambient.

Another advantage of the invention is the resistance against heat transferred around the lock mechanism. Since the portion of the door which retains the lock or lock mechanism is particularly susceptible to heat transfer, the present invention incorporates mineral wool surrounding the lock areas. Thermal insulation is provided adjacent the lock pocket in the active door and adjacent the free edge of the inactive door by the use of a flexible thermally insulating material such as mineral wool. A C-shaped section of mineral wool surrounds the mortise lock or the lock mechanism on the active door. An elongated section of mineral wool extending from the door top to the door bottom surrounds the locking rod in an inactive door. Mineral wool or stone wool is a furnace product of molten rock at a temperature of about 1600° C., through which a stream of air or steam is blown. More advanced production techniques are based on spinning molten rock on high speed spinning wheels somewhat like the process used to prepare cotton candy. The final product is a mass of fine, intertwined fibres with a typical diameter of 6 to 10 micrometers. Mineral wool may contain a binder. The mineral wool employed in the present invention may comprise a mineral wool fiber that employs a modified urea extended phenolic cured resin binder. The preferred mineral wool is Delta brand mineral wool available from Rock Wool Manufacturing Company of Leeds, Ala.

Further improving the resistance to heat transfer, ceramic paper extends substantially the length of the door and is positioned on the side of the door facing the combustion source, adjacent the lock edge stiffener. The ceramic paper resists heat transfer in a portion of the fire door which does not have a gypsum panel. The sheets of ceramic paper generally extending over the stiffener and overlapping the edge of the gypsum panel, beneath the door skins. A ceramic paper which may be employed in the present invention is a ceramic fiber product manufactured from alumina-silica materials into paper and other sheet-like forms, which are referred to herein generally as ceramic paper. The ceramic paper generally has a wide temperature range for applications from 1500° F. to 3000° F. Ceramic paper is processed from washed, spun, high purity fibers formed into highly flexible sheet. Ceramic paper contains an organic binder to provide increased handling strength at room temperature. The ceramic paper employed in the present invention may comprise refractory ceramic fibers (RCF) in a binder of Acrylic acid and polymers. The preferred ceramic paper is Inswool 2300 paper available from ANH Refractories Company of Moon Township, Pa.

The use and placement of C-channel stiffeners and the additional mineral wool and ceramic paper insulation are believed to contribute to the good fire performance of the door of the present invention by limiting the formation of gaps and openings as the door distorts.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insulated fire door comprising:

a door shell having spaced first and second exterior panels, a first vertical door edge and a second vertical door edge opposite the first door edge;

a first gypsum panel between the first and second exterior panels;

a plurality of first spacers bonded across an interior side of each of the first and second exterior panels, the spacers extending inward from the first and second exterior panels and contacting the first gypsum panel; the spacers maintaining the first gypsum panel in a spaced position from the interior sides of the first and second exterior panels as the door bows during a fire on one side of the door, until the gypsum disintegrates;

a lock pocket for receiving a lock, the lock pocket disposed adjacent the second door edge;

a second gypsum panel disposed below the lock pocket and a third gypsum panel disposed above the lock pocket; and a stiffener extending vertically within the door between the interior sides of the first and second exterior panels, the stiffener disposed adjacent to the lock pocket away from the second door edge;

wherein the first gypsum panel extends horizontally from the first door edge to the stiffener, the second gypsum panel extends horizontally from the stiffener to the second door edge and the third gypsum panel extends horizontally from the stiffener to the second door edge.

2. The door of claim 1 wherein each of the spacers has a flat portion contacting the gypsum panel, a leg extending from the flat portion spacing the gypsum from the interior sides of the first and second exterior panels, and a flange extending from the leg bonding the spacer to the first and second exterior panels.

3. The door of claim 1 wherein the spacers have a length and wherein the length extends vertically within the door.

4. The door of claim 1 wherein the spacers are welded to the first and second exterior panels.

5. The door of claim 1 wherein the stiffener has a leg spacing the interior sides of the first and second exterior panels and flanges extending from the leg bonding the stiffener to at least one of the first and second exterior panels.

6. The door of claim 1 further including a mineral wool insulation extending along a top, bottom and side of the lock pocket between the first and second exterior panels.

7. The door of claim 1 including a lock edge retainer disposed between the stiffener and the lock pocket.

8. The door of claim 1 wherein the door has hinges along a first edge thereof, and further including additional spacers extending vertically between the first and second exterior panels, the additional spacers disposed between the stiffener and the second door edge above and below adjacent the lock pocket.

9. The door of claim 1 including a sheet of ceramic paper extending over the stiffener and overlapping a portion of each of the gypsum panels.

10. The door of claim 9 including a second piece of ceramic paper over the stiffener.

11. The door of claim 1 wherein each of the gypsum panels has a thickness sufficient to permit heat from a fire on one side of the door to flow through the gypsum panel and cause the first and second exterior panels to bow substantially uniformly as a result of thermal expansion thereof, while maintaining sufficient spacer contact with the gypsum panels and having sufficient thermal insulation to meet a fire code, until the gypsum disintegrates.

12. The door of claim 1 wherein the door has a width less than about 32 in. (0.81 m).

13. The door of claim 12 wherein the door has a height greater than about 84 in. (2.13 m).

14. An insulated fire door system having as an active door the door of claim 1 and an inactive door, wherein the active door has hinges along a door edge and the inactive door has hinges along a first inactive door edge and a strike pocket along a second inactive door edge opposite the first inactive door edge, the active and inactive doors meeting at their second edges.

15. The door system of claim 14 wherein the active door has a flexible thermal insulation around the lock pocket between the first and second exterior panels and wherein the inactive door has a strike pocket along the second edge and a flexible thermal insulation along the second edge between the first and second exterior panels.

16. A method of using a fire door comprising:

providing the insulated fire door of claim 1, with the plurality of spacers maintaining substantially only air space between the first exterior panel and the gypsum panel and the second exterior panel and the gypsum panel;

exposing the door to a heat source on one side of the door;

causing the door to bow toward the heat source as a result of thermal expansion of the first and second exterior panels; and using the spacers, maintaining the gypsum panel in a spaced position from the interior sides of the first and second exterior panels as the door bows, until the gypsum disintegrates.

* * * * *